US006450476B1

(12) United States Patent
Hassmann et al.

(10) Patent No.: US 6,450,476 B1
(45) Date of Patent: Sep. 17, 2002

(54) FORMWORK FOR PRODUCING ARTICLES OF CONCRETE

(75) Inventors: Christian Hassmann, Mittelneufnach; Andreas Schaab, Aschaffenburg; Jürg Hausser, Vettelschoss, all of (DE)

(73) Assignee: Johns Manville International, Inc., Denver, CO (US)

( * ) Notice: Subject to any disclaimer, the term of this patent is extended or adjusted under 35 U.S.C. 154(b) by 0 days.

(21) Appl. No.: 09/271,692

(22) Filed: Mar. 18, 1999

(30) Foreign Application Priority Data

Mar. 21, 1998 (DE) ..... 198 12 517

(51) Int. Cl.[7] ..... B28B 7/36; E04G 9/10
(52) U.S. Cl. ..... 249/113; 29/428
(58) Field of Search ..... 249/113; 264/219

(56) References Cited

U.S. PATENT DOCUMENTS 3,780,975 A * 12/1973 Turzillo ..... 249/113
4,055,322 A * 10/1977 Cassidy ..... 249/112
4,856,754 A 8/1989 Yokota et al. ..... 249/113
5,302,099 A 4/1994 Serafini ..... 249/113
5,820,775 A * 10/1998 Hiller et al. ..... 249/113
5,824,347 A * 10/1998 Serafini ..... 249/113

FOREIGN PATENT DOCUMENTS

DE 91 17 039.7 U1 6/1995
DE 196 23 584 A1 12/1997
EP 0 646 684 A1 4/1995
GB 2 175 635 A * 12/1986 ..... 249/113

OTHER PUBLICATIONS

Patent Abstracts of Japan, M–1214, Feb. 25, 1992, vol. 16, No. 77.

* cited by examiner

*Primary Examiner*—Robert Davis
(74) *Attorney, Agent, or Firm*—Burns, Doane, Swecker & Mathis, LLP

(57) ABSTRACT

Formwork for producing articles of concrete is described, comprising a supporting means, a latticed sheet-like structure attached fast to the supporting means and a nonwoven fabric attached to the latticed sheet-like structure by means of a suitable adhesive.

17 Claims, No Drawings

FORMWORK FOR PRODUCING ARTICLES OF CONCRETE

The invention relates to formwork for producing articles of concrete, where a so-called form interlay is applied to the supporting member.

In order to produce an article of concrete, in particular structural part of concrete, a corresponding set of forms is required for the reception of fresh concrete. Formwork is an aid which is used for only a short time at the building side or even at manufacturing locations where finished parts are produced. Nevertheless, as a rule its production entails great expense.

Formwork has a whole series of tasks. First of all, of course, it is meant to constitute the form into which fresh concrete is poured and in which the concrete becomes firm. On the other hand, it should provide the article of concrete, a wall, for example, with an appropriate surface.

In particular, structures of concrete whose surfaces are severely stressed during use require high surface quality. Examples of such structures are sewage treatment systems, hydraulic structures, such as locks or dams or tunnels, and retaining walls. As a rule, concrete surfaces have high surface quality when the surface is as smooth and impervious as possible. Then pollutants or water are unable to penetrate the structural material and damage it by frost, for example.

In addition, there is a problem in that fresh concrete normally contains more water than is required for hydration. So upon the consolidation of concrete the water penetrates from the inside of the form to the outside, so that the marginal zones contain more water. This water must be carried off in order for the quality of the surface not to be impaired.

In order to reduce the problems outlined above, it has already been sought to obtain a remedy with various so-called concrete form interlays. By concrete form interlays are meant usually textile sheet-like structures having patterned or smooth surfaces, which are applied to the supporting means on the side of the formwork that comes into contact with fresh concrete. Thus, there is described in EP-0,562,044 B1 a concrete form interlay which consists of a one-piece, porous, two-sided textile sheet-like structure, in which the first side has a pore size of 0.2 to 20 $\mu$m, and the second side has a pore size that is greater than the pore size of the first side and lies between 10 and 250 $\mu$m. This interlay is capable of carrying off water and provides for a better surface finish of the concrete. However, the fact that it must be spread out very carefully on the supporting means is disadvantageous. If this is done carelessly, pouring of concrete into the form results in the formation of folds, which adversely affect the surface finish of the concrete member. In addition, spreading is a labor-intensive step which, by the way, can only be performed by especially qualified workers.

Formwork for producing articles of concrete, which comprises a supporting means and a porous formwork inlay that rests on the supporting means but is not attached to the latter, is described in EP-0,662,028 B1. There the inlay consists of a porous textile material which is laminated on a dehydrating lattice structure material. The problem of attachment of the inlay to the supporting means arises in this design, too. In addition, according to the manufacturer's information, this concrete form interlay can be used only twice at most.

Lastly, in EP-0,812,943 A there is described a concrete form interlay which is made up essentially of a nonwoven fabric of fibers whose titers are between 0.7 and 3 dtex, the nonwoven fabric having a maximum tensile elongation of at least 300 N and a surface finish corresponding to a pore size of 1 to 80 $\mu$m. This nonwoven fabric may also be combined with a lattice provided with spacing elements. Here, too, the problem arises that these interlays must be carefully spread.

Incidentally, all known interlays suffer from the disadvantage that they can be reused in only limited fashion, since upon setting of the concrete the interlays become clogged with particles of concrete and upon separation after the concrete sets they are often mechanically damaged.

Hence, there is still a need for improved formwork that consists of supporting means with concrete form interlays.

The object of the invention therefore is to make available formwork for producing article of concrete which advantageously carries off excess water during setting of the concrete and provides the surface with the prescribed good surface finish, which can be produced simply and quickly, which requires no complicated measures for stretching the lining, which can be set up quickly at the building site even by workers who are not very skilled, and which can be reused repeatedly without great expense and loss of material.

This object is accomplished by formwork for producing articles of concrete comprising a) a supporting means, b) a latticed sheet-like structure attached fast to the supporting means, c) a nonwoven fabric attached to the latticed sheet-like structure by means of a suitable adhesive.

Formwork panels preferably are used as supporting means. These are usually factory-made, in particular rectangular panels of solid wood, plywood or metal. Form boards may alternatively serve as supporting means.

The latticed sheet-like structure is attached to the supporting means, i.e., is arranged not only abutting but so that it adheres firmly to the supporting member, in other words, is neither displaceable nor able to form folds. The tacking technique is preferred for this, particularly with supporting members of wood; then tacking may be done right in the manufacturing facility, but of course it is alternatively possible for this to be done on the building site.

Latticed sheet-like structures, also called lattice structure materials, are known per se and are described in EP-0,812,943 A, EP-0,662,028 B1 and in U.S. Pat. No. 4,815,892, to the disclosure of which reference is expressly made here.

The latticed sheet-like structure may be present as a lattice woven fabric, a cross-lay or as a net-shaped structure, for example as film with punched-out holes. Preferably, it consists of synthetic material, in particular polypropylene, polyvinyl chloride (PVC), polyethylene and the like. The latticed sheet-like structure may alternatively be made of steel, high-grade steel or sheet metal, e.g., wire mesh, expanded metal, perforated plates, etc. In addition, it is possible, for example, for the layer producing spacing already to be a component of the supporting formwork when the surface is appropriately shaped, in order to separate nonwoven fabric from the latticed sheet-like structure. Very suitable is a woven spacing fabric of polypropylene made by the Tenax Kunststoffe firm in Lindau, which has a mesh size of approximately 3 mm×3 mm and a web width of approximately 1 mm and a total thickness of approximately 2 mm.

It is important for the latticed sheet-like structure to be sturdy, so that it can absorb the pressures produced in concrete work substantially without deformation. The geometric ratio of hole size to web area must be designed so that, on the one hand, a sufficiently great adhesion area is available for the nonwoven fabric to be applied, but so that, on the other hand, a sufficient hole area is present in order to allow the water to flow away unhindered.

The latticed sheet-like structure preferably is applied flush with the supporting means; however, it is alternatively possible to apply a greater area, so that the overhanging edge areas must be drawn over the edges of the supporting member.

The nonwoven fabric is attached to the latticed sheet-like structure by means of a suitable adhesive. For this purpose, the latticed fabric is first provided with an adhesive, in particular with a spray-on adhesive. The quantity of adhesive applied must be great enough, on the one hand, for the spacing elements of the lattice on the side turned toward the nonwoven fabric to be sufficiently provided with adhesive, so that the fabric can adhere satisfactorily, but, on the other hand, the quantity should not be so great that the interspaces of the lattice become completely filled up with the adhesive. The quantity preferably is sized so that at least 50% of the lattice hole area is free from adhesive. So-called pressure-sensitive adhesives, which permit the fabric to be separated or pulled off after use, may alternatively be used. In addition, spreadable adhesives and roll-on adhesives are suitable.

The nonwoven fabric may be applied directly to the latticed sheet-like structure provided with adhesive and fixed by simple contact pressure. Particularly suitable nonwoven fabrics are those which are made up of fibers whose titers lie between 0.7 to 4 dtex, preferably 1 to 3 dtex, especially preferably 1.5 to 2.6 dtex. Nonwoven fabrics of this type are described in EP-0,812,943 A. Reference is made particularly to the disclosure in this European patent application.

Adhesives that can be sprayed on are especially suitable. However, the adhesive may alternatively be applied by rolling or spreading.

The suitable adhesive is optimized so that the nonwoven fabric, after removal from the form, can be separated from the latticed sheet-like structure without any significant expenditure of force. This is possible when, for example, the adhesive effect is weakened by the high alkalinity of the concrete.

Alternatively, the adhesive effect of the adhesive may also be fine-tuned so that only a small force is necessary for removal from the form.

Especially preferred as adhesives are so-called alkali-soluble adhesives, which start to dissolve or are largely dissolved by the alkaline water seeping out during setting and hardening of the concrete. This causes the adhesive to lose its adhesive effect.

Spray-on adhesives such as, for example, Spray Adhesive 75 or, alternatively, an aerosol adhesive made by 3M Deutschland GmbH in Neuss, are very suitable.

The nonwoven fabric may be designed smooth on the side that comes into contact with the concrete, but it may alternatively be structured.

It was especially surprising that the invention makes available formwork with which articles of concrete are produced in very economical and simple fashion. The formwork ensures very good dehydration of the concrete. After removal from the form the nonwoven fabric can very simply be pulled away from the latticed sheet-like structure and, since the adhesive readily separates from the lattice and the latter is left practically intact, the supporting means with the latticed sheet-like structure can be used repeatedly, i.e., a new nonwoven fabric can be applied again. In general, removal of the latticed overlay is necessary only after being used 20 to 30 times. In addition, the finished formwork may be stored at the building site without the nonwoven fabric being separated from the latticed underlay, since the adhesive is not weakened by rain water.

Production and use of this formwork according to the invention is considerably less costly than other known products, since use of such formwork saves material and time.

The formwork is suitable for all conventional types of formwork, such as formwork with and without pattern. It can be used especially advantageously in the construction of sewage systems, water containers, rainwater storage reservoirs, locks, dikes, dams, bridge piers, tunnels, retaining walls, etc.

The formwork according to the invention holds cement and additives in outstanding fashion and allows air and water to escape effectively.

The invention is explained in detail by the following example:

A polypropylene sheet-like structure, as a latticed sheet-like structure, having a mesh width of 5 mm, made by the TENAX Kunststoffe firm in Lindau, is tacked to a 1-m by 2-m wooden panel, so that it is firmly joined with the panel. The sheet-like structure is then sprayed with 3M's Spray Adhesive No. 75 so that it is largely coated with a layer of the adhesive and the interspaces of the meshes contain as little adhesive as possible. Then, a nonwoven fabric is laid, smooth and free of folds, on the sheet-like structure and is fixed by contact pressure. The edges of the nonwoven fabric are turned over and attached on the front or back of the formwork. The formwork is assembled and filled with fresh concrete. The form interlay applied acts as a filter. It retains cement and additive and allows air and water to escape. The hardened concrete surface is impervious and firm and substantially free from pores and cavities. After sufficient hardening of the concrete, the formwork is removed. The nonwoven fabric can readily be removed from the latticed overlay. The supporting member with the latticed sheet-like structure can again be used immediately for overlay of a new nonwoven fabric and as insert for making concrete work.

What is claimed is:

1. Formwork for producing articles of concrete, comprising a) a supporting means, b) a latticed sheet-like structure attached fast to the supporting means, c) a nonwoven fabric attached to the latticed sheet-like structure by an adhesive.

2. Formwork for producing articles of concrete, comprising a) a supporting means, b) a latticed sheet-like structure attached fast to the supporting means, c) a nonwoven fabric attached to the latticed sheet-like structure by an adhesive, wherein the nonwoven fabric is attached by an alkali-soluble adhesive.

3. Formwork according to claim 1, wherein the nonwoven fabric is attached by a pressure-sensitive adhesive.

4. Formwork according to claim 1, wherein the latticed sheet-like structure is tacked onto the supporting means.

5. Formwork according to claim 4, wherein the tackings are in each instance applied at a spacing of from 1 to 10 cm.

6. Formwork according to claim 1, wherein the latticed sheet-like structure is glued, screwed or welded on to the supporting means.

7. Formwork according to claim 1, wherein the latticed sheet-like structure is an integral part of the supporting means.

8. Formwork according to claim 1, wherein the nonwoven fabric is attached by a spray-on adhesive.

9. Formwork according to claim 1, wherein the nonwoven fabric is attached by a spreadable or roll-on adhesive.

10. Formwork according to claim 1, wherein a quantity of the adhesive is such that spacing elements of the lattice on a side of the lattice turned toward the nonwoven fabric are substantially provided with adhesive and the adhesive at least partially fills up some holes of the lattice between the spacing elements.

11. Formwork according to claim 10, wherein the holes between the spacing elements are filled with adhesive to at most 50% of their volume.

12. Formwork according to claim 1, wherein the nonwoven fabric is made up of fibers whose titer is between 0.7 to 4 dtex, the nonwoven fabric has a maximum tensile strength of at least 300 N in the longitudinal direction and at least 250 N in the transverse direction, measured on a 5 cm-wide strip, and a surface finish corresponding to a pore size of from 1 to 80 $\mu$m.

13. Formwork according to claim 12, wherein the nonwoven fabric is made up of polyester fibers which consist of at least 95% polyethylene terephthalate of an intrinsic viscosity of 0.5 to 1.4 dl/g, measured by solutions with dichloroacetic acid at 25° C.

14. Formwork according to claim 1, wherein the latticed sheet-like structure is a latticed woven fabric.

15. Formwork according to claim 1, wherein the latticed sheet-like structure is a perforated plate or a perforated panel of synthetic material.

16. Formwork according to claim 1, wherein the latticed sheet-like structure has a mesh width of 2 to 15 mm.

17. Method for making formwork for producing articles of concrete, comprising:

attaching a latticed sheet-like structure over a total surface area of a supporting means;

providing the latticed sheet-like structure with sufficient adhesive that spacing elements of the lattice on a side of the lattice turned toward the nonwoven fabric are substantially provided with adhesive and at least some perforations on the lattice are at least partially filled with the adhesive; and applying a nonwoven fabric over a total area of the latticed sheet-like structure;

smoothing and fixing the nonwoven fabric on the latticed sheet-like structure by contact pressure.

* * * * *